US007733279B2

(12) United States Patent
Hozouri

(10) Patent No.: US 7,733,279 B2
(45) Date of Patent: Jun. 8, 2010

(54) MULTI-BAND OR WIDE-BAND ANTENNA INCLUDING DRIVEN AND PARASITIC TOP-LOADING ELEMENTS

(76) Inventor: Behzad Tavassoli Hozouri, 3707 Poinciana Dr. #91, Santa Clara, CA (US) 95051

( * ) Notice: Subject to any disclaimer, the term of this patent is extended or adjusted under 35 U.S.C. 154(b) by 289 days.

(21) Appl. No.: 11/918,021

(22) PCT Filed: Apr. 6, 2006

(86) PCT No.: PCT/US2006/013128

§ 371 (c)(1),
(2), (4) Date: Oct. 5, 2007

(87) PCT Pub. No.: WO2006/110564

PCT Pub. Date: Oct. 19, 2006

(65) Prior Publication Data

US 2009/0109096 A1 Apr. 30, 2009

(51) Int. Cl.
*H01Q 1/24* (2006.01)

(52) U.S. Cl. ..... 343/702; 343/700 MS

(58) Field of Classification Search ..... 343/700 MS, 343/702, 846

See application file for complete search history.

(56) References Cited

U.S. PATENT DOCUMENTS

| | | | |
|---|---|---|---|
| 4,907,006 | A | 3/1990 | Nishikawa et al. |
| 5,532,708 | A | 7/1996 | Krenz et al. |
| 6,433,756 | B1 | 8/2002 | Sievenpiper et al. |
| 6,670,921 | B2 | 12/2003 | Sievenpiper et al. |
| 6,727,854 | B2 | 4/2004 | Fang et al. |
| 6,788,257 | B2 | 9/2004 | Fang et al. |

(Continued)

FOREIGN PATENT DOCUMENTS

| | | |
|---|---|---|
| KR | 10-2007-7022833 | 11/2009 |

(Continued)

OTHER PUBLICATIONS

Guo, Yong-Xin et al., a Quarter-Wave U-Shaped Patch Antenna With Two Unequal Arms for Wideband and Dual-Frequency Operation, IEEE Transactions on Antennas and Propagation, vol. 50, No. 8, Aug. 2002.

(Continued)

*Primary Examiner*—HoangAnh T Le
(74) *Attorney, Agent, or Firm*—Workman Nydegger

(57) ABSTRACT

A monopole-type antenna (10) for multi- or wide-band use to transmit or receive radio frequency electromagnetic energy. A feed point (12) provides energy into the antenna or receives energy from the antenna. A driven radiating section (16) includes a first top-loading element (22) and a feed conductor (20) that electrically connects the feed point linearly to the first top-loading element, yet with the driven radiating section not electrically connected to a grounding surface (14). A parasitic radiating section (18) includes a second top-loading element (26) and a bridge conductor (24) that electrically connects the second top-loading element linearly to the grounding surface When energy is then provided at the feed point and conducted to the driven radiating section, it produces a first resonance mode, coupling at least some of the energy into and exciting the parasitic radiating section to produce a second resonance mode.

18 Claims, 6 Drawing Sheets

U.S. PATENT DOCUMENTS

| | | | | |
|---|---|---|---|---|
| 6,812,902 | B2 | 11/2004 | Rossman et al. | |
| 6,859,181 | B2 * | 2/2005 | Colburn et al. | 343/725 |
| 6,917,341 | B2 | 7/2005 | Ishihara et al. | |
| 6,943,730 | B2 | 9/2005 | Poilasne et al. | |
| 6,977,616 | B2 | 12/2005 | Yuanzhu | |
| 2001/0048391 | A1 | 12/2001 | Annamaa et al. | |
| 2003/0122718 | A1 | 7/2003 | Fang et al. | |
| 2004/0061652 | A1 * | 4/2004 | Ishihara et al. | 343/752 |
| 2004/0150567 | A1 | 8/2004 | Yuanzhu | |
| 2004/0227675 | A1 | 11/2004 | Harano | |
| 2005/0057400 | A1 * | 3/2005 | Yuanzhu | 343/700 MS |
| 2005/0237258 | A1 * | 10/2005 | Abramov et al. | 343/834 |
| 2006/0022889 | A1 * | 2/2006 | Chiang et al. | 343/833 |

FOREIGN PATENT DOCUMENTS

| | | | |
|---|---|---|---|
| WO | 03077360 | A1 | 9/2003 |
| WO | 2004/109857 | A1 | 12/2004 |

OTHER PUBLICATIONS

PCT/US06/13128, Aug. 31, 2006, International Search Report.
EP 06749555.6, Mar. 6, 2008, European Search Report.
EP 06749555.6, May 21, 2008, Office Action.

* cited by examiner

MULTI-BAND OR WIDE-BAND ANTENNA INCLUDING DRIVEN AND PARASITIC TOP-LOADING ELEMENTS

TECHNICAL FIELD

The present invention relates generally to radio wave antennas, and more particularly to such with lumped reactance at the free end for loading the antenna. It is anticipated that this invention will particularly be used with small and wireless communication devices.

BACKGROUND ART

Antennas for wireless communication equipment, for example pagers, cell phones and WLAN access points must be small in size, light in weight, compact in physical volume, and cheap to manufacture. Flush mounted or built-in internal antennas are therefore often desired or even required. Also, devices that communicate with wireless services often must operate in different frequency bands, due to different geographical band allocation schemes, different wireless providers, different wireless services, or different wireless communication protocols. Such devices accordingly require an antenna or multiple antennas that are responsive to multiple frequency bands. A single antenna is preferable for obvious reasons of size, appearance, and cost. One current example of a single antenna application is multi-band reception and transmission by high-end WLAN access points, which need to accommodate all of the 802.11 a/b/g protocols.

There are already several designs for external multi-band antennas, but a compact multi-band antenna that can be housed internally or on the external device housing is often highly preferred. Unfortunately, existing internal antennas are either not very compact or else trade off performance quality to achieve smaller size. Some antenna designs today also trade off increased cost to reduce size, through the use of materials with high dielectric constants which are usually expensive. One technique used for this is to employ a slow-wave structure to miniaturize the antenna, such as a meander line shape. Unfortunately, that adds to the electromagnetic energy loss incurred. This is inefficient in many applications, and is often a sever disadvantage in applications where battery capacity is a concern.

Various attempts have been made to improve antennas to address the above concerns. One common approach today is to use a patch type antenna.

The classic patch antenna is a rectangular metallic film mounted above a ground plane. However, a patch antenna must be about a half wavelength in size, which for most terminal applications is not suitable. One popular method to reduce size is to use dielectrics with a high dielectric constant. This adds weight and loss and reduces the antenna bandwidth. Another way to reduce size is to incorporate specialized grounding. By doing this, the added inductance to the capacitive planar antenna shifts antenna resonance to a lower frequency. Known as Planar Inverted F Antennas (PIFA), the design of this group of antennas normally includes some kind of slot, thus adding electrical length to the antenna. However the main common characteristics of the standard and shorted patch antennas is that the metal structure parallel to the ground is the main radiating structure, and not the feed or shorting circuits. For monopoles, it is the other way around. Even when monopole antennas use some top-loaded elements, these are reactive elements, not the main radiating structures.

A discussion of some dual- and wide-band examples is provided in GUO et al., "A Quarter-Wave U-Shaped Patch Antenna With Two Unequal Arms For Wideband And Dual-Frequency Operation," IEEE Transactions On Antennas And Propagation, Vol. 50, No. 8, August 2002. Due to the antenna shape, and also being a patch type antenna, it has not the proper performance and bandwidth.

U.S. Pat. No. 6,788,257 by Fang, et al. teaches a variation of the PIFA-patch type antenna, wherein a driven element is electrically connected to a ground plane with a shorting pin and excites a parasitic shorted radiating patch to produce another resonance mode by the coupling of energy. However, the performance is not adequate for many applications.

Published pat. app. WO 2004/109857 by Iguchi et al. teaches a PIFA-type structure based on parasitically coupling between the directly fed radiating element and the shorted radiating element, but one that has not been able to provide a reasonable bandwidth for the proper performance.

Published pat. app. US 2004/0227675 by Harano and U.S. Pat. No. 4,907,006 by Nishikawa, et al. use parasitic coupling. However, due to non-optimal shapes the overall antennas sizes are big. Published pat. app. WO 03/077360 by Andersson teaches yet other variations, which has a high SAR issue, as it is not completely on one side of the ground plane.

Published pat. app. US 2001/0048391 by Annamaa et al. teaches a variation of the PIFA-type structure that is fed parasitically, e.g. through a conductive strip placed on the same insulating board. The feed conductor of the whole antenna structure then is in galvanic contact with the feed element. However, this technique has not been able to overcome the bandwidth issue due to its patch-type nature. To lower the resonance frequencies, it adds slots or spiral type configurations to increase the efficient path the current flows through.

Of course, other types of antenna structures are possible. For example, published pat. app. US 2004/0150567 by Yuanzhu teaches an antenna using meandering portions and capacitive conductor portions provided on a surface of a dielectric substrate perpendicularly provided with respect to a grounding conductor plate. As noted in passing above, however, this approach is not as efficient as desired due to narrow bandwidth and also increasing loss.

Still another type of antenna structure is represented by published pat. app. US 2004/0061652 by Ishihara et al. This is titled "Top-Loading Monopole Antenna Apparatus With Short-Circuit Conductor Connected Between Top-Loading Electrode And Grounding Conductor" and seemingly contradicts the widely held belief that monopole-type antennas, can operate efficiently over only a narrow band of frequencies. As will be seen in the following discussion, this makes the Ishihara invention particularly relevant to the present invention. However, due to its non-optimum shape and its configuration of the main and parasitic top loading elements, reasonable bandwidth can not be obtained, requiring the use of discrete reactive elements in many cases, as has been indicated in the patent.

DISCLOSURE OF INVENTION

Accordingly, it is an object of the present invention to provide antennas that are particularly suitable for multi-band or wide-band usage.

Briefly, one preferred embodiment of the present invention is a monopole-type antenna for multi- or wide-band use to transmit or receive radio frequency electromagnetic energy. A feed point, provides energy into the antenna or receives energy from the antenna. A driven radiating section includes a first top-loading element and a feed conductor that electrically connects the feed point linearly to the first top-loading element, yet with the driven radiating section not electrically connected to a grounding surface. A parasitic radiating section includes a second top-loading element and a bridge conductor that electrically connects the second top-loading element linearly to the grounding surface. When energy is then provided at the feed point and conducted to the driven radiating section, it produces a first resonance mode, coupling at least some of the energy into and exciting the parasitic radiating section to produce a second resonance mode.

An advantage of the present invention is that it provides multiple operating bands or one wide operating band for wireless communications devices.

Another advantage of the invention is that it is suitable for use in applications where space is limited, or where compactness or minimum visibility are desired.

Another advantage of the invention is that it can be economically manufactured, using commonly available materials and manufacturing techniques.

And another advantage of the invention is that its antenna volume may flexibly incorporate simply air or a dielectric material that permits additional antenna size reduction.

These and other objects and advantages of the present invention will become clear to those skilled in the art in view of the description of the best presently known mode of carrying out the invention and the industrial applicability of the preferred embodiment as described herein and as illustrated in the figures of the drawings.

BRIEF DESCRIPTION OF THE DRAWINGS

The purposes and advantages of the present invention will be apparent from the following detailed description in conjunction with the appended figures of drawings in which.

In the various figures of the drawings, like references are used to denote like or similar elements or steps.

BEST MODE FOR CARRYING OUT THE INVENTION

Figure 1A:
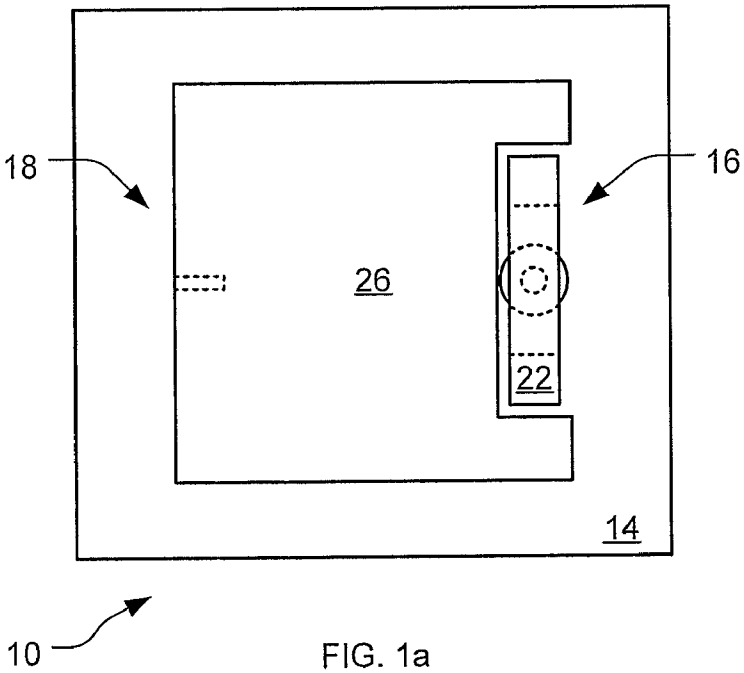
FIGS. 1*a-d* depict a top plan view, a left side view, a front side view, and a perspective view of one embodiment of an antenna that is in accord with the present invention.
Figure 1B:
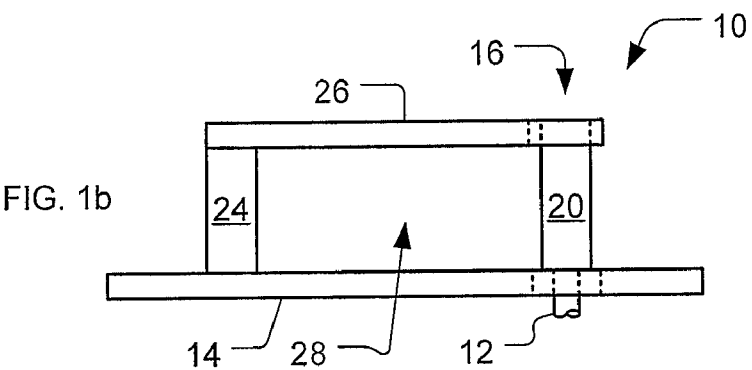
Figure 1C:
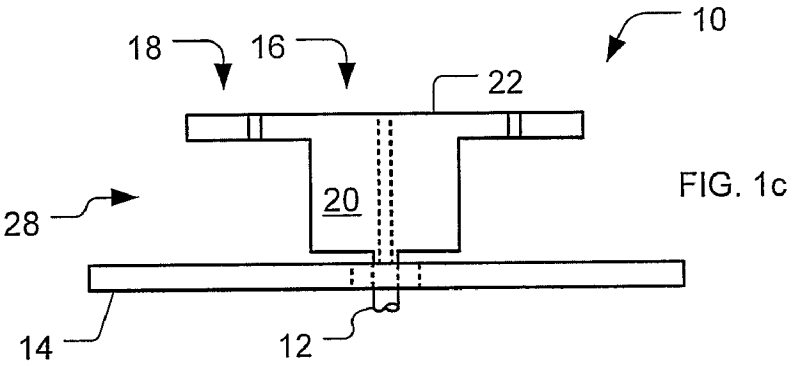
Figure 1D:
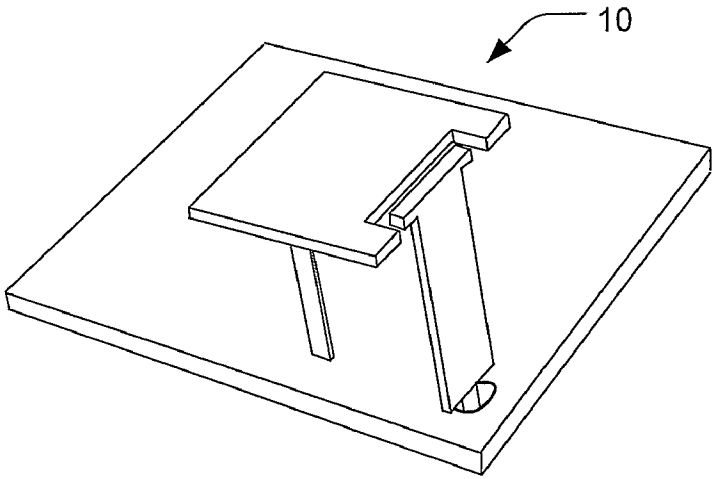

A preferred embodiment of the present invention is a multi-band antenna. As illustrated in the various drawings herein, and particularly in the view of FIGS. 1*a-d*, preferred embodiments of the invention are depicted by the general reference character 10.

As is common practice in this art when antennas capable of use for transmission and reception are discussed, we herein label elements and describe their roles in the context of transmission. Those skilled in the art will readily appreciate that the same elements can nonetheless also serve in reception.

FIGS. 1*a-d*, respectively, depict a top plan view, a left side view, a front side view, and a perspective view of an embodiment of the inventive antenna 10 that is in accord with the present invention. The antenna 10 here includes a feed point 12, a grounding conductor or grounding surface 14, a driven radiating section 16, and a parasitic radiating section 18.

The driven radiating section 16 includes a feed conductor 20 that electrically connects the feed point 12 to a first top-loading element 22, and the parasitic radiating section 18 includes a bridge conductor 24 that electrically connects a second top-loading element 26 to the grounding surface 14. The top-loading elements 22, 26 are opposed to the grounding surface 14, and between the top-loading elements 22, 26 and the grounding surface 14 an antenna volume 28 is created.

In operation for transmission, energy is provided at the feed point 12 and conducted to the driven radiating section 16 where it produces a first resonance mode. Through the coupling of energy, the parasitic radiating section 18 is then excited and creates a second resonance mode. The result is a compact, efficient multi- or wide-band radiating structure.

In the inventor's presently preferred embodiment, only metal (or metal-plated plastic) is used to construct the antenna 10. These materials can be shaped easily, as desired, by using various well-know techniques. In one embodiment the antenna volume 28 is simply left open. In a second embodiment, however, a dielectric material partially or completely fills the antenna volume 28, to assist even further in reduction of the size of the antenna 10.

The feed point 12 can be essentially conventional. Similarly, the grounding surface 14 can be conventional. Typically, it will be a plane, but this is not an absolute requirement. For example, a large cylindrical structure such as a water tank can serve as the grounding surface 14. In this case, the grounding surface 14 can be thought of as effectively planar. In another example, however, an irregular surface, such as the roof panel of an automobile, can serve as the grounding surface 14. The shape of the grounding surface 14 in this situation may not be optimal but may nonetheless still be adequate for the particular application.

The driven radiating section 16 and the parasitic radiating section 18 should not be confused with somewhat similar appearing elements in patch-type antennas. The antenna 10 here is of the monopole-type. The first top-loading element 22 and the second top-loading element 26 act essentially like capacitors. As a result, the antenna 10 can fill dual- and wide-band roles and is not subject to the particular size and shape constraints of patch-type antennas.

Figure 2A:
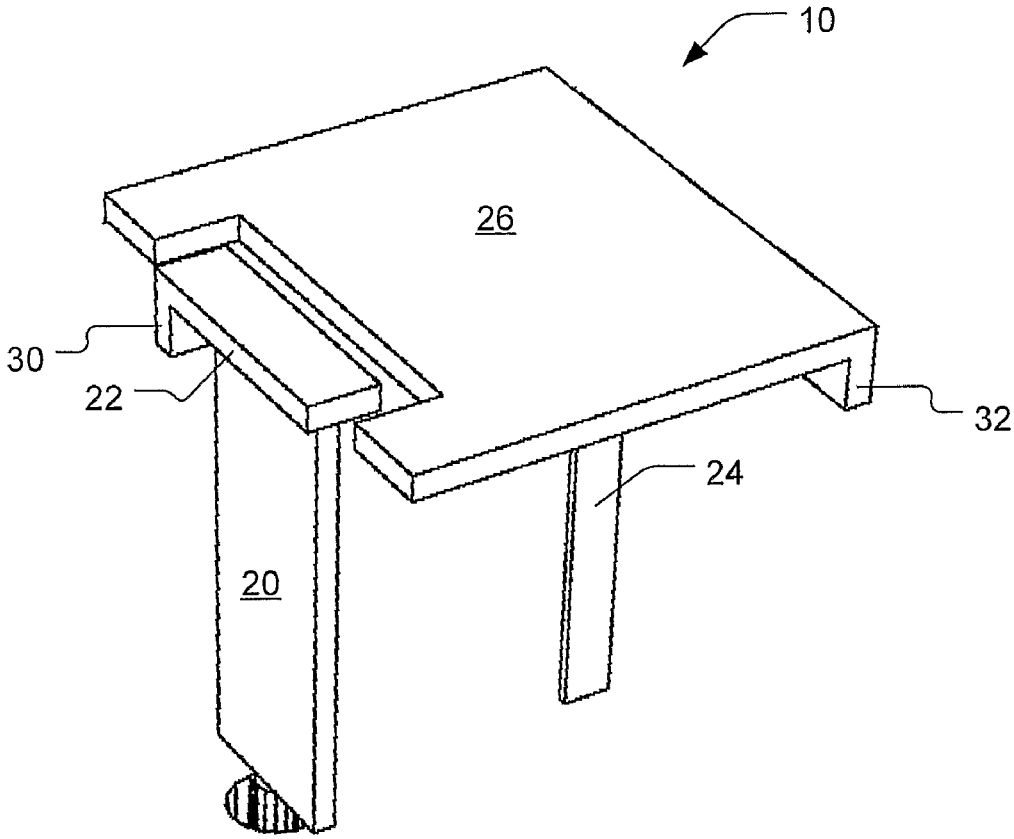
FIGS. 2*a-b* are perspective views of alternate embodiments of the antenna, wherein in FIG. 2*a* the top-loading elements have altering sub-elements and in FIG. 2*b* the shape of the feed conductor is altered.
Figure 2B:
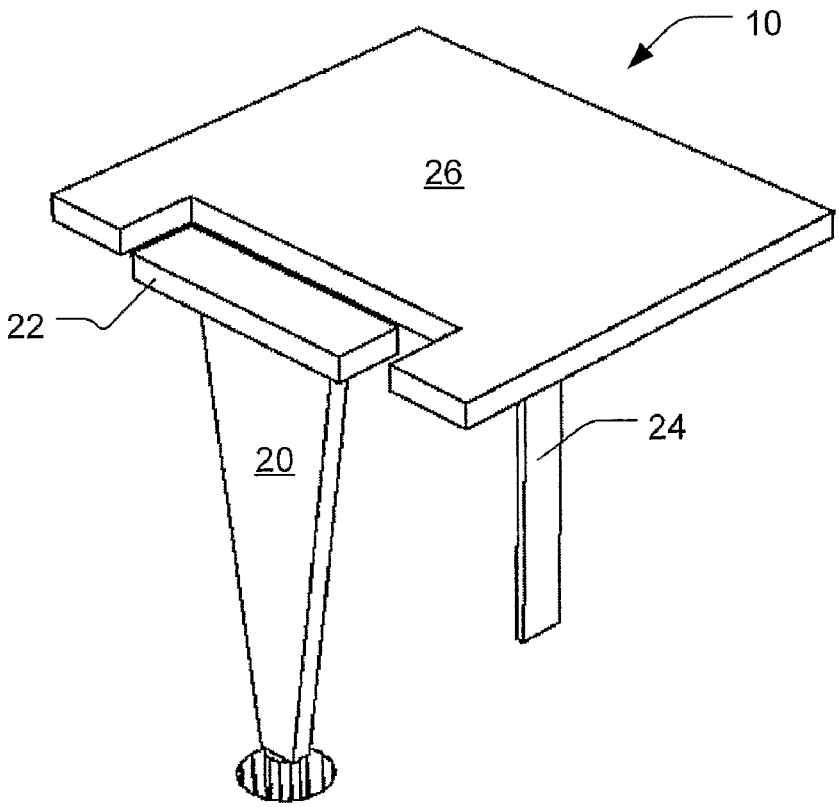
Figure 3A:
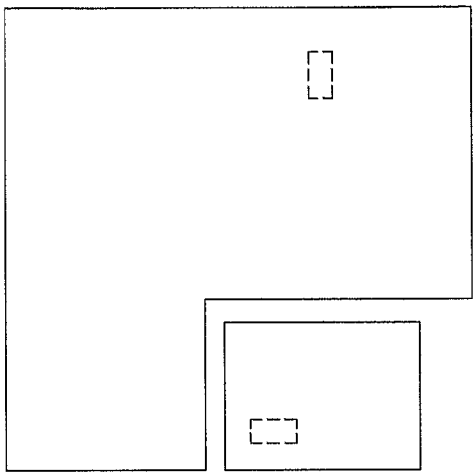
FIGS. 3*a-l* are a series of top plan views showing some other possible shapes for the top-loading elements of the antenna.
Figure 3B:
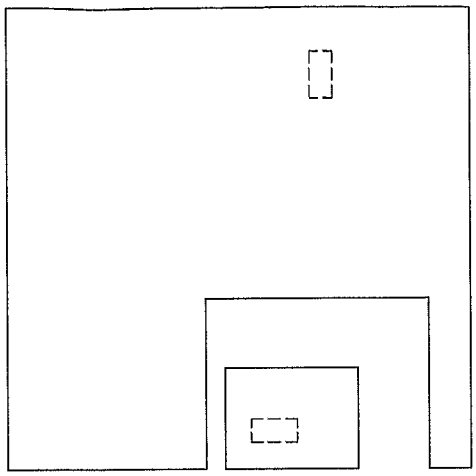
Figure 3C:
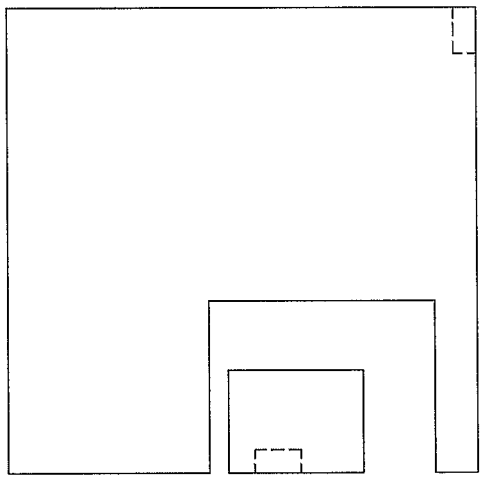
Figure 3D:
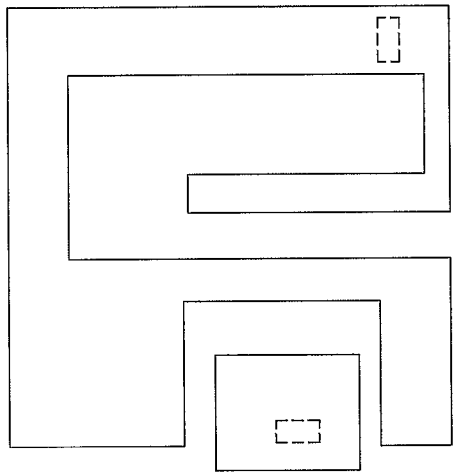
Figure 3E:
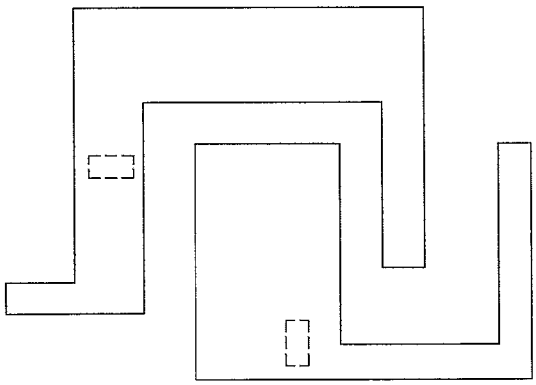
Figure 3F:
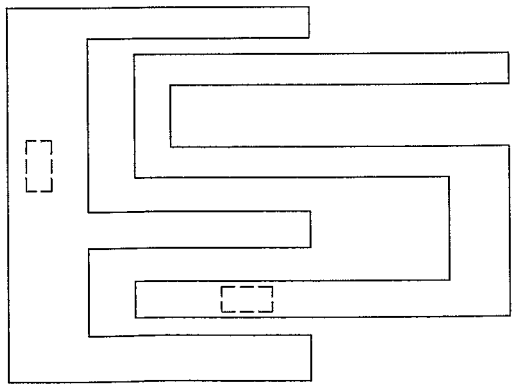
Figure 3G:
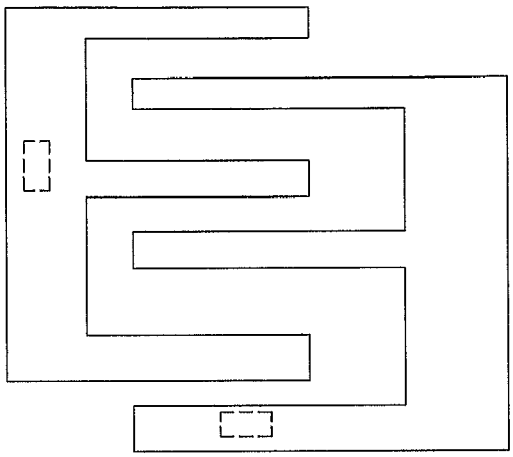
Figure 3H:
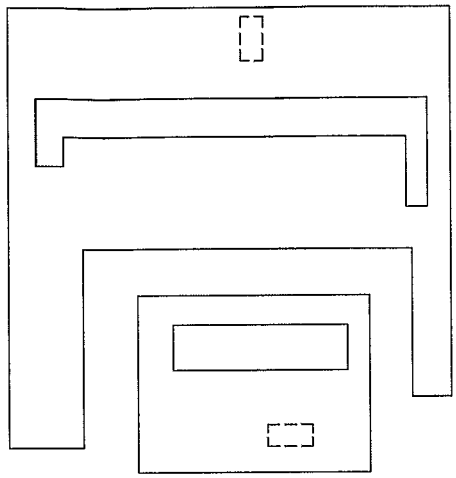
Figure 3I:
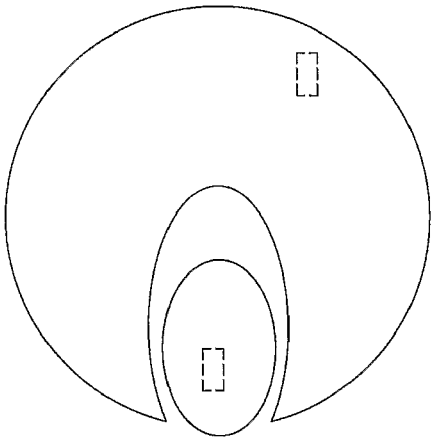
Figure 3J:
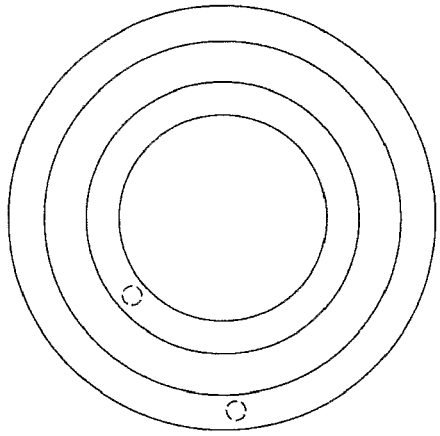
Figure 3K:
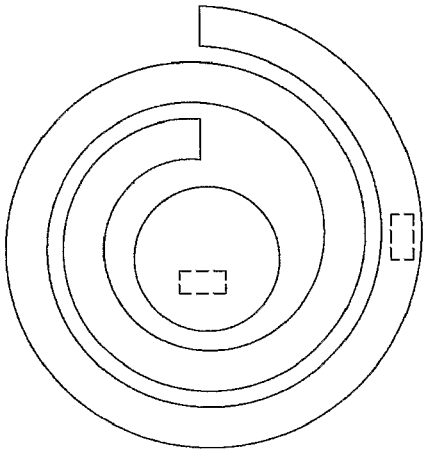
Figure 3L:
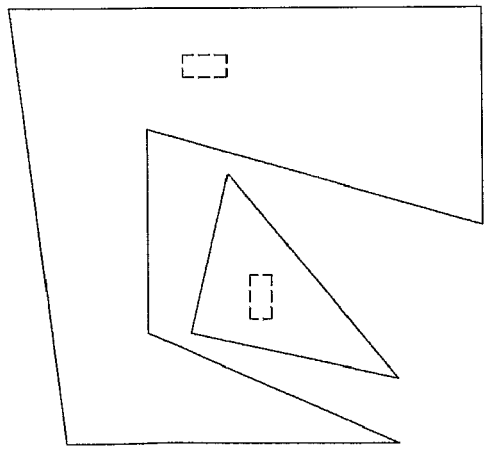

FIGS. 2*a-b* are perspective views of two alternate embodiments of the antenna 10. In FIG. 2*a*, the top-loading elements 22, 26, respectively, have a first altering element 30 and a second altering element 32. Such sub-elements can be used, for instance, to change the aesthetic appearance of the antenna 10. More typically, however, they will be used to additionally broaden the bandwidth or change the frequency of operation of the antenna 10. Adding "stubs" to antennas for this purpose is known in the art, and could be used, for example, for fine-tuning the top-loading reactive value or resonance frequencies.

FIG. 2*b* shows that the shape of the feed conductor 20 can be altered. This can be done to improve impedance matching; and the shape of the bridge conductor 24 can similarly be altered somewhat (not shown).

FIGS. 3*a-l* are a series of top plan views showing, without limitation, some possible other shapes for the top-loading elements in other alternate embodiments of the antenna 10.

Figure 4:
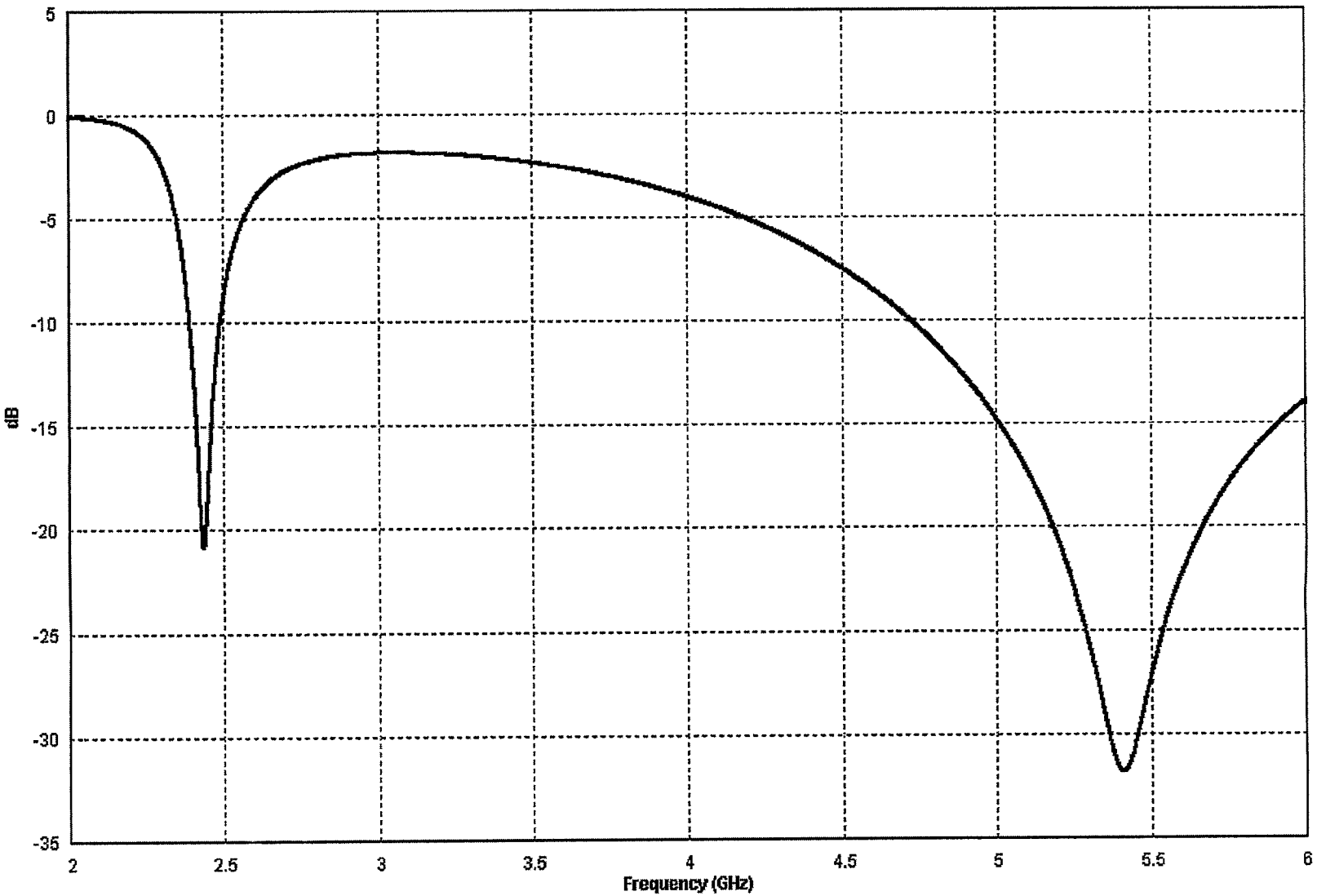
FIG. 4 is a graph showing performance of a dual-band embodiment of the antenna.

FIG. 4 is a graph showing return loss of one embodiment of the inventive antenna 10 that is especially suitable for dual-band usage. This graph particularly illustrates that the antenna 10 here has two adequately wide regions that meet the −10 dB threshold criteria for return loss. Accordingly, the antenna 10 here has one band centered at 2.4 gHz and a second band centered at 5.4 gHz. This specific example is suitable to cover all of the current 802.11 a/b/g protocols.

Figure 5:
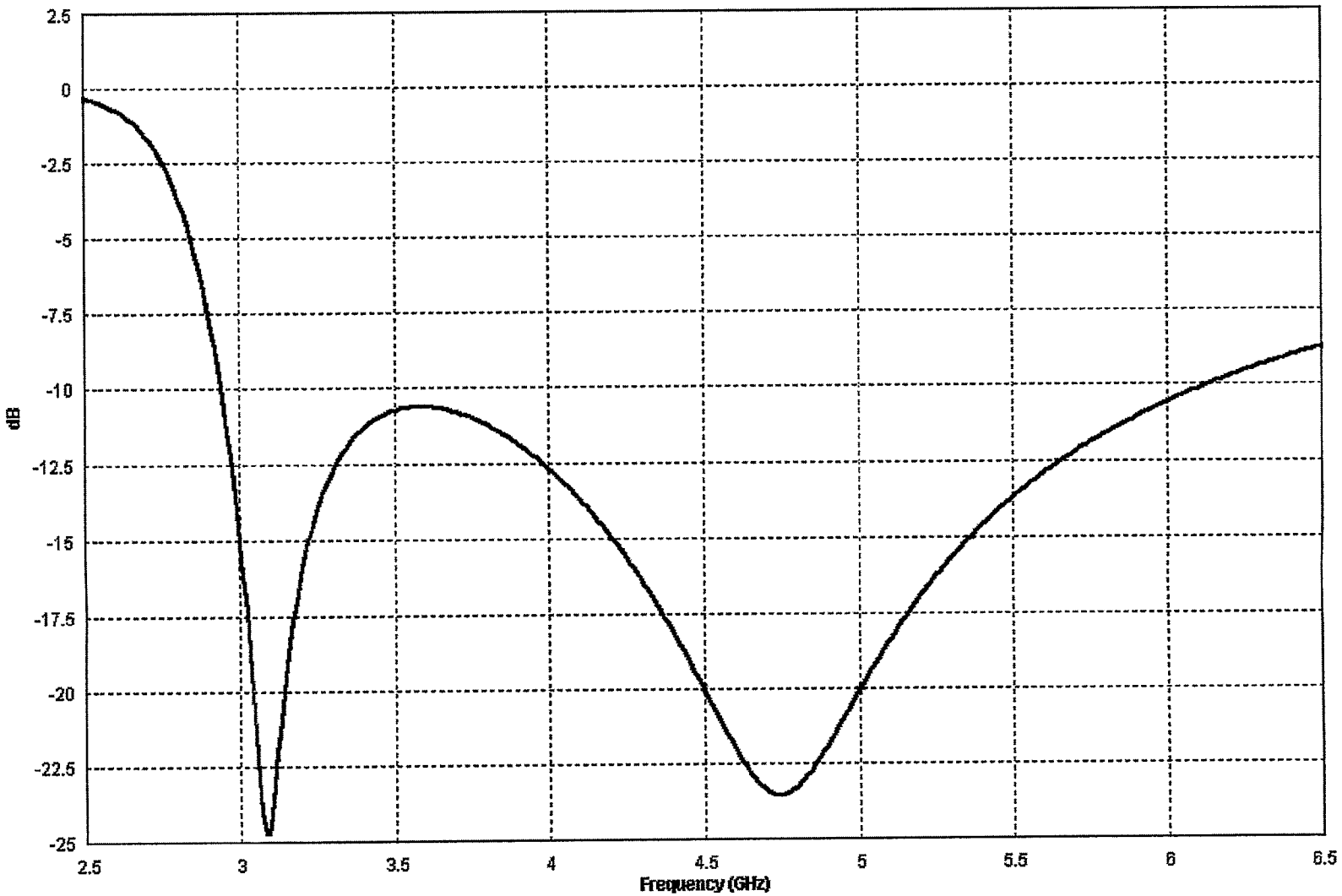
FIG. 5 is a graph showing performance of a wide-band embodiment of the antenna.

FIG. 5 is a graph showing performance of an embodiment of the inventive antenna 10 that is especially suitable for wide-band usage. This graph particularly illustrates that the antenna 10 here has one broad region that meets the −10 dB threshold criteria for return loss. The antenna 10 here thus has one very broad band extending from 2.9 gHz to 6.2 gHz, which could be used for ultrawideband applications.

In sum, embodiments of the inventive antenna 10 can provide sufficient bandwidth for use as either multi- or wide-band antennas. Concurrently, these embodiments can be simple, compact, and economical to manufacture. This makes such embodiments highly suitable for use in modem wireless communication devices, and particularly in compact configurations suitable to be used in locations where little space is available, or where minimum visibility is required.

While various embodiments have been described above, it should be understood that they have been presented by way of example only, and not limitation. Thus, the breadth and scope of the invention should not be limited by any of the above described exemplary embodiments, but should be defined only in accordance with the following claims and their equivalents.

The invention claimed is:

1. An antenna for multi- or wide-band use to transmit or receive radio frequency electromagnetic energy, comprising:

a feed point, to receive the energy into the antenna or to provide the energy from the antenna;

a driven radiating section including a first top-loading element and a feed conductor that electrically connects said feed point to said first top-loading element, wherein said driven radiating section is not electrically connected to a grounding surface; and a parasitic radiating section including a second top-loading element and a bridge conductor that electrically connects said second top-loading element to said grounding surface, wherein:

said second top-loading element includes a flat plate defining a slot; and said first top-loading element is positioned within said slot.

2. The antenna of claim 1, wherein said first and second top-loading elements are opposed to said grounding surface.

3. The antenna of claim 2, wherein said first and second top-loading elements and said grounding surface form an antenna volume therebetween and said antenna volume is at least partially filled with a dielectric material other than air.

4. The antenna of claim 1, wherein said first and second top-loading elements are coplanar.

5. The antenna of claim 1, wherein at least one of said first and second top-loading elements includes an altering portion to broaden the bandwidth or change the frequency of operation of the antenna.

6. The antenna of claim 1, wherein said driven radiating section and said parasitic radiating section are dimensioned such that the antenna has at least two separate frequency bands that meet a −10 dB threshold criteria for return loss, thereby making the antenna suitable for multi-band use.

7. The antenna of claim 1, wherein said driven radiating section and said parasitic radiating section are dimensioned such that the antenna has a frequency bandwidth of at least 3 GHz that meets a −10 dB threshold criteria for return loss, thereby making the antenna suitable for wide-band use.

8. The antenna of claim 1, wherein said driven radiating section and said parasitic radiating section are concentric with each other.

9. The antenna of claim 1, wherein said parasitic radiating section is in the form of a spiral disposed about the said driven radiating section.

10. The antenna of claim 1, wherein said antenna is constructed of at least one of metal and metal-plated plastic.

11. An antenna for multi- or wide-band use to transmit or receive radio frequency electromagnetic energy, comprising:

feed point means for receiving the energy into the antenna or to provide the energy from the antenna;

driven radiating means including:

first top-loading means for producing a first resonance mode, and feed conducting means for electrically connecting said feed point means to said first top-loading means, wherein said driven radiating means is not electrically connected to a grounding means; and a parasitic radiating means including:

second top-loading means for producing a second resonance mode, and bridge conductive means for electrically connecting said second top-loading means to said grounding means, wherein:

said second top-loading means includes a flat plate defining a slot: and said first top-loading means is positioned within said slot.

12. The antenna of claim 11, wherein said first and second top-loading means are opposed to said grounding means.

13. The antenna of claim 12, wherein said first and second top-loading means and said grounding means form an antenna volume therebetween and said antenna volume is at least partially filled with a dielectric material other than air.

14. The antenna of claim 11, wherein said first and second top-loading means are coplanar.

15. The antenna of claim 11, wherein at least one of said first and second top-loading means includes an altering means to broaden the bandwidth or change the frequency of operation of the antenna.

16. The antenna of claim 11, wherein said driven radiating means and said parasitic radiating means are dimensioned such that the antenna has at least two separate frequency bands that meet a −10 dB threshold criteria for return loss thereby making the antenna suitable for multi-band use.

17. The antenna of claim 11, wherein said driven radiating means and said parasitic means section are dimensioned such that the antenna has a frequency bandwidth of at least 3 GHz that meets a −10 dB threshold criteria for return loss, thereby making the antenna suitable for wide-band use.

18. An antenna for multi- or wide-band use to transmit or receive radio frequency electromagnetic energy, comprising:

a feed point operational to receive energy into the antenna or to transmit the energy from the antenna;

a driven radiating section including a first flat plate a feed conductor that electrically connects said feed point to said first flat plate, wherein said driven radiating section is not electrically connected to a grounding surface; and a parasitic radiating section including a second flat plate that is coplanar with respect to the first flat plate, the parasitic radiating section having a notch sized to receive the first flat plate and a conductor that electrically connects said second flat plate to said grounding surface.

* * * * *